US005551594A

United States Patent [19]

Schäfer

[11] Patent Number: 5,551,594

[45] Date of Patent: Sep. 3, 1996

[54] BOX-SHAPED CONTAINER OF PLASTICS MATERIAL

[75] Inventor: Gerhard Schäfer, Neunkirchen, Germany

[73] Assignee: Fritz Schäfer Gesellschaft mit beschränkter Haftung, Neunkirchen, Germany

[21] Appl. No.: 335,581

[22] Filed: Nov. 8, 1994

[30] Foreign Application Priority Data

Nov. 8, 1993 [DE] Germany ..... 43 38 063.8

[51] Int. Cl.[6] ..... B65D 6/00

[52] U.S. Cl. ..... 220/675; 220/1.5; 220/635

[58] Field of Search ..... 220/1.5, 628, 633, 220/635, 675

[56] References Cited

U.S. PATENT DOCUMENTS

| | | | |
|---|---|---|---|
| 3,985,258 | 10/1976 | Quigley et al. | 220/1.5 X |
| 4,000,827 | 1/1977 | Emery | 220/1.5 X |
| 4,197,958 | 4/1980 | Zeni et al. | 220/675 |
| 4,375,265 | 3/1983 | van de Wetering et al. | 220/1.5 |
| 4,674,647 | 6/1987 | Gyenge et al. | 220/1.5 X |
| 4,775,068 | 10/1988 | Reiland et al. | 220/1.5 X |
| 4,936,615 | 6/1990 | Moore | 220/1.5 X |
| 5,397,022 | 3/1995 | Schäfer | 220/635 X |
| 5,460,292 | 10/1995 | Holman | 220/675 |

*Primary Examiner*—Steven M. Pollard
*Attorney, Agent, or Firm*—Friedrich Kueffner

[57] ABSTRACT

A box-shaped container of plastics material, particularly a storage and transport container includes a bottom with a flat upper side and a bottom side which is stabilized by stiffening ribs. Flat webs extending in a plane parallel to the plane of the bottom extend along the rim of the bottom. The flat webs form in the manner of a frame a center field of the bottom. The stiffening ribs in the center field intersect each other in the manner of a grid. The flat webs form support surfaces of the container and rest spaced apart from the plane of the bottom on stiffening ribs arranged transversely of the rim of the bottom. Pocket-shaped free spaces are formed between the bottom side of the container bottom, the upper sides of the flat webs and the transversely extending stiffening ribs, wherein the free spaces are completely open to the side of the rim of the bottom. The stiffening ribs which support the flat webs are not connected to the longitudinally and transversely extending stiffening ribs of the center field of the bottom of the container.

9 Claims, 3 Drawing Sheets

BOX-SHAPED CONTAINER OF PLASTICS MATERIAL

BACKGROUND OF THE INVENTION

1. Field of the Invention

The present invention relates to a box-shaped container of plastics material, particularly a storage and transport container. The container has a bottom with a flat upper side and a bottom side which is stabilized by stiffening ribs. Flat webs extending in a plane parallel to the plane of the bottom extend along the rim of the bottom. The flat webs form in the manner of a frame a center field of the bottom. The stiffening ribs in the center field intersect each other in the manner of a grid. The flat webs form support surfaces of the container and rest spaced apart from the plane of the bottom on stiffening ribs arranged transversely of the rim of the bottom. Pocket-shaped free spaces are formed between the bottom side of the container bottom, the upper sides of the flat webs and the transversely extending stiffening ribs, wherein the free spaces are completely open to the side of the rim of the bottom.

2. Description of the Related Art

A box-shaped container of the above-described type is known from German Patent 39 09 022. The flat webs which surround the rim portion in the manner of a frame form a bottom surface which can travel on roller conveyors, such that the box-shaped container is in the rim portion thereof provided with a second bottom, wherein the flat webs which form the lower bottom are connected through stiffening ribs to the bottom side of the actual bottom of the container in such a way that pockets are formed which are open toward the sides. The transition to the center field of the bottom is closed off over the circumference by vertical web walls at the inwardly directed rims of the flat webs. The transverse ribs and longitudinal ribs supporting the flat webs as well as the longitudinally and transversely extending stiffening ribs of the grid of ribs of the center field of the bottom are connected to the circumferentially extending vertical web. In other words, the center field of the bottom and the flat webs form an interconnected unit.

In a box-shaped container known from German Patent 41 05 527, which is improved over the box-shaped container described above, the longitudinally and transversely extending stiffening ribs of the grid of ribs of the center field of the bottom are spaced apart from the inwardly directed rims of the flat webs, so that tunnel-like free spaces are obtained between the bottom side of the container bottom, the upper sides of the flat webs and the transversely extending stiffening ribs. In contrast to the pockets of German Patent 39 09 022, which are closed at the transition to the center field of the bottom, the openings or passages at opposite ends of the tunnel-like free spaces of the container of German Patent 41 05 527 permit an almost completely unobstructed flow of cleaning liquids through the free spaces, so that, particularly when the cleaning liquids are introduced as liquid jets, the cleaning liquids can wash out all undesired residues from the free spaces. In the box-shaped container according to German Patent 41 05 527, the transverse ribs or longitudinal ribs, which support the flat webs and project inwardly beyond the flat webs, extend to the center field of the bottom and are connected to the transversely and longitudinally extending stiffening ribs of the center field.

It has been found that when high loads are placed in these known containers, even though the stiffening ribs are provided, not only the center field of the bottom, but also the bottom surface, i.e., the flat webs at the rim areas, are being bent. This may negatively influence the travel properties of the container on a roller conveyor.

SUMMARY OF THE INVENTION

Therefore, it is the primary object of the present invention to improve the stiffening means of the bottom of a box-shaped container of the above-described type.

In accordance with the present invention, the stiffening ribs which support the flat webs are not connected to the longitudinally and transversely extending stiffening ribs of the center field of the bottom of the container.

Accordingly, the present invention is based on the finding that, when the border area or bottom surface is uncoupled from the central field of the container bottom, bending occurring in the center field has no influence on the surrounding bottom surface or the flat webs. This is because the bottom surface is uncoupled from the central field of the bottom, i.e., since the stiffening ribs of the flat webs are not connected to the stiffening ribs of the center field of the bottom, the bottom surface does not participate in movements of the center field of the bottom which are caused by bending.

In accordance with a further development of the invention, the stiffening ribs supporting the flat webs extend into the center field of the container bottom and are arranged in an overlapping manner with longitudinal ribs or transverse ribs extending from the grid-like center field of the container bottom. Even though the stiffening ribs supporting the flat webs are not connected to the other stiffening ribs, the box-shaped container according to the present invention has a very high stiffness.

The container may be an injection molded article of plastics material.

In accordance with another proposal according to the present invention, the transverse ribs are each arranged between two end branches of the transversely extending stiffening ribs, wherein the end branches extend in the direction toward the flat webs. The longitudinal ribs are arranged adjacent to rib extensions of the stiffening ribs of the flat webs extending along the short sides of the container. While at the short sides of the container the longitudinal ribs overlapping the stiffening ribs of the flat webs constitute the extension of the longitudinally extending stiffening ribs of the grid of ribs of the center field of the bottom, the transversely extending stiffening ribs of the grid of ribs of the center field of the bottom at the long sides of the container are extended only by short end branches which, in accordance with an advantageous feature, are located opposite and at a short distance from the stiffening ribs of the flat webs. The transverse ribs are each arranged in the middle between two adjacent end branches. This configuration of the bottom side of the container makes it possible to place great loading weights into the container.

In accordance with a preferred feature of the present invention, the stiffness of the container is further improved by connecting at their point of intersection in the center field of the bottom the stiffening ribs arranged immediately in the corner areas of the frame-like support surface formed by the flat webs. In addition, a stiffening angle or arch may be arranged spaced from each corner rib connection toward the center field of the bottom. As a result, an otherwise unnecessarily large free space is provided with stiffening members.

In accordance with another configuration of the bottom of the container, in which the circumferentially extending flat webs are uncoupled from the center field of the bottom, the inwardly directed rims of the flat webs forming the frame-like support surface are spaced from a circumferentially closed rib border member of the center field of the bottom. In that case, the stiffening ribs of the flat webs and of the center field of the bottom are not arranged so as to overlap each other. Rather, the stiffening ribs of the flat webs and of the center field of the bottom are arranged separate from each other as a result of the distance from the circumferential rib border member of the center field of the bottom. In this configuration, the stiffening ribs of the flat webs present at the short sides and the long sides of the container do not project from the flat webs toward the center field of the bottom.

In accordance with another proposal of the present invention, the stiffening ribs of the grid of ribs are provided at at least one location with an opening near the bottom surface of the container. Consequently, when the container is inverted for cleaning the container with a water jet, any water collecting in the grid of ribs can flow outwardly toward the tunnel-like free spaces and from there over the rim of the container.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
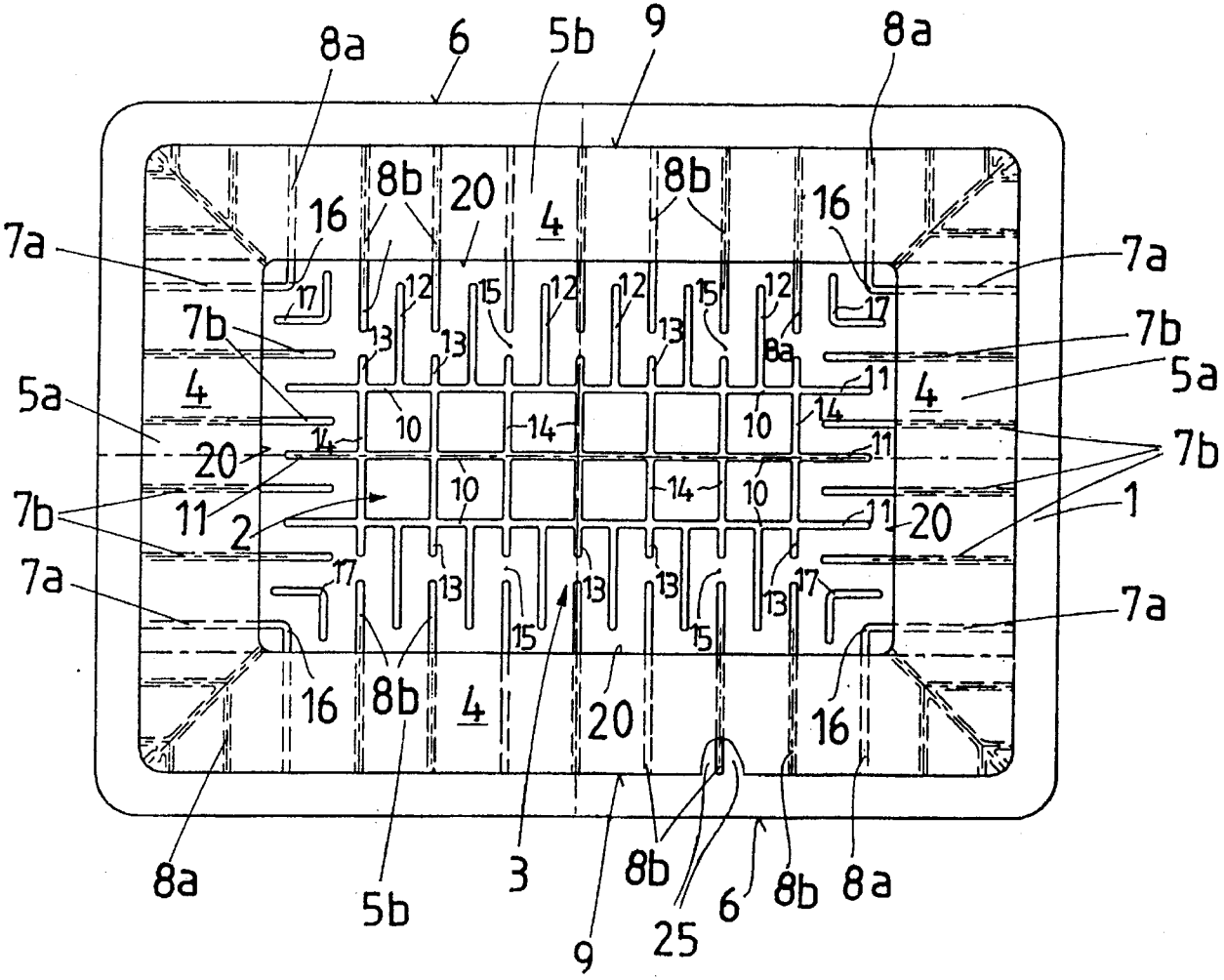
FIG. 1 is a bottom view of a container according to the present invention.

The bottom 1 shown in each of the figures of the drawing is manufactured as an injection molded article of plastics material. The bottom 1 may be a component of a box-shaped container as it is predominantly used as a storage and transport container for use in shelf systems, and the container is particularly suitable for use in those shelf systems in which conveying tracks are arranged in addition to automatic feeding and removal units. However, the features to be described below could also be provided on trays, pallets or similar storage and transport means which can be manufactured as injection molded articles of plastics material.

The upper side of the bottom 1 is essentially flat. As illustrated in FIG. 1, on the bottom side of the bottom 1 are provided a center field 3 having a two-row grid 2 of ribs and a support surface 4 formed by flat webs 5*a* and 5*b* which extend circumferentially in the rim area of the container and are capable of traveling on roller conveyors. The flat webs 5*a* arranged at the short sides of the container are supported by vertical stiffening ribs 7*a*, 7*b* extending parallel to the bottom rim 6 and the flat webs 5*b* are supported by vertical stiffening ribs 8*a*, 8*b* extending transversely of the bottom rim 6. Accordingly, the flat webs are arranged at a distance from and are essentially uncoupled from the bottom surface of the container. The flat webs 5*a*, 5*b* are integrally formed with the box-shaped container or the container bottom 1. Accordingly, the flat webs 5*a*, 5*b* form a frame which is arranged in such a way that its outer rims 9 are inwardly offset relative to the bottom rim 6.

The stiffening ribs 7*a*, 7*b* and 8*a*, 8*b* which support the flat webs 5*a*, 5*b* extend into the center field 3 of the bottom and are arranged so as to overlap with longitudinal ribs 11 and transverse ribs 12. The configuration is such that either a longitudinal rib 11 or transverse rib 12 extends between two adjacent stiffening ribs 7*b* or 8*b* or a stiffening rib 7*b* or 8*b* extends between two longitudinal ribs 11 or transverse ribs 12. The transverse ribs 12 extending from the longitudinally extending stiffening ribs 10 of the grid 2 of ribs are arranged in the middle between two short end branches 13 of the transversely extending stiffening ribs 14 of the grid 2 of ribs, wherein the short end branches 13 extend toward the flat webs 5*b*, and the longitudinal ribs 11 are arranged adjacent to the stiffening ribs 7*b* for the flat webs 5*a* on the short sides of the container, wherein the stiffening ribs 7*b* extend into the center field 2 of the bottom. The end branches 13 are located in alignment with and at a distance 15 from the stiffening ribs 8*b* of the flat webs 5*b* on the long sides of the container, wherein the stiffening ribs 8*b* extend into the center field 3 of the bottom. In order to prevent unnecessarily large free areas of the center field 3 of the bottom without stiffening means, the stiffening ribs 7*a*, 8*a* arranged immediately in the corner areas of the support surface 4 formed by the flat webs 5*a*, 5*b* are connected at their point of intersection in the center field of the bottom by a corner rib connection 16. In addition, a stiffening angle 17, possibly in the form of a circular arch, is arranged adjacent the corner rib connection 16 in the center field 3, wherein the sides of the stiffening angle 17 overlap the corner rib connection 16.

Figure 2:
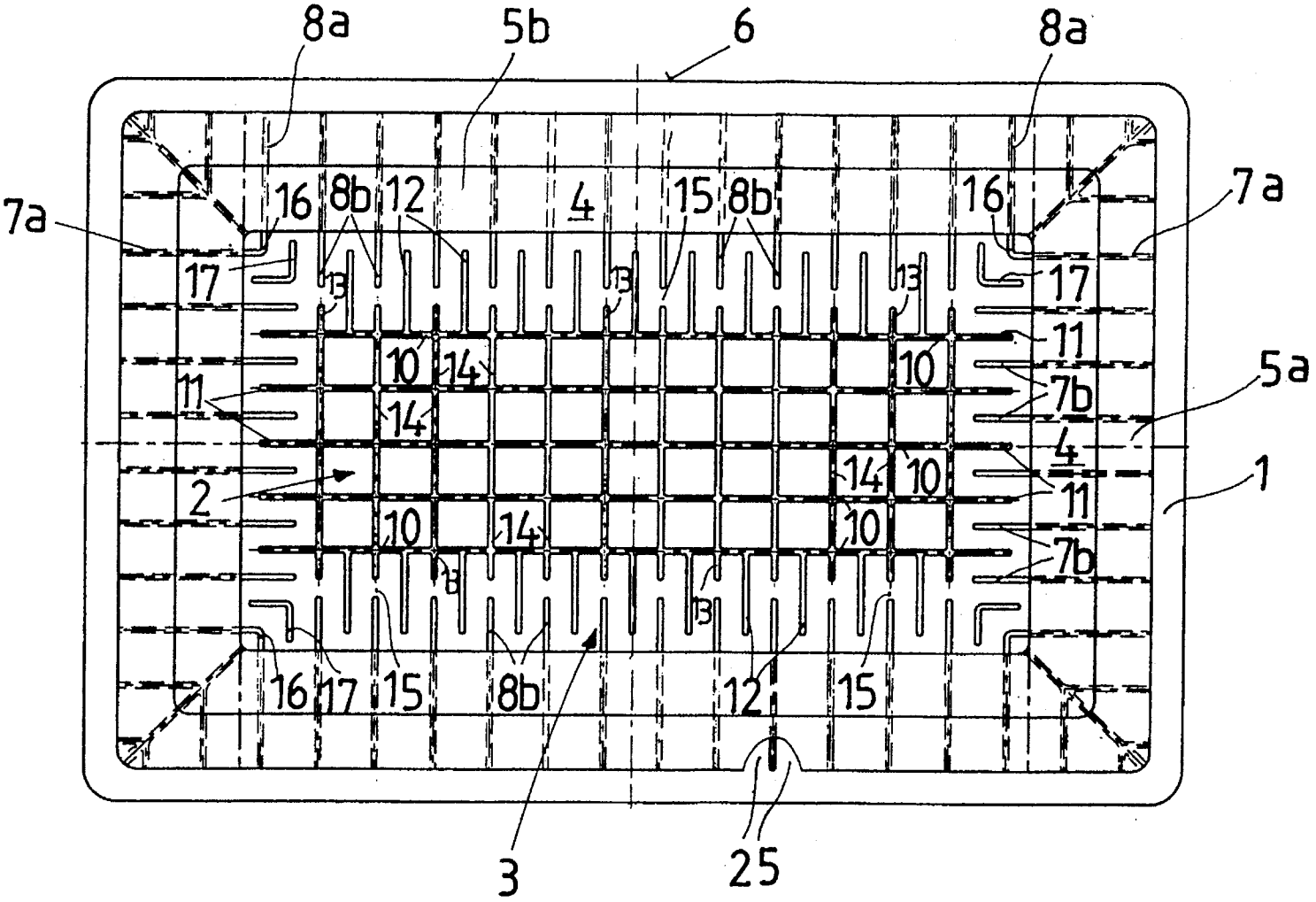
FIG. 2 is a bottom view of another embodiment of the container according to the present invention.

The bottom 1 illustrated in FIG. 2 differs from the bottom shown in FIG. 1 essentially only with respect to its dimensions. In other words, the bottom 1 of FIG. 2 is intended for a larger container and, therefore, has a four-row grid 2 of ribs in its center field 3 instead of a two-row grid 2 as in the bottom 1 of FIG. 1. Also, in this case, the stiffening ribs 7*a*, 7*b* and 8*a*, 8*b* which support the flat webs 5*a*, 5*b* are constructed without connection to the stiffening ribs of the center field 3, so that the support surface 4 is uncoupled from the center field 3 of the bottom 1. When the center field 3 of the bottom 1 is bent, the circumferentially extending support surface 4 of the container does not participate in a disadvantageous manner in the movement of the center field 3. Also, in this case, the stiffening of the bottom of the container which is necessary in spite of the fact that the support surface 4 is uncoupled from the center field 3, is achieved by the overlapping stiffening ribs.

Figure 3:
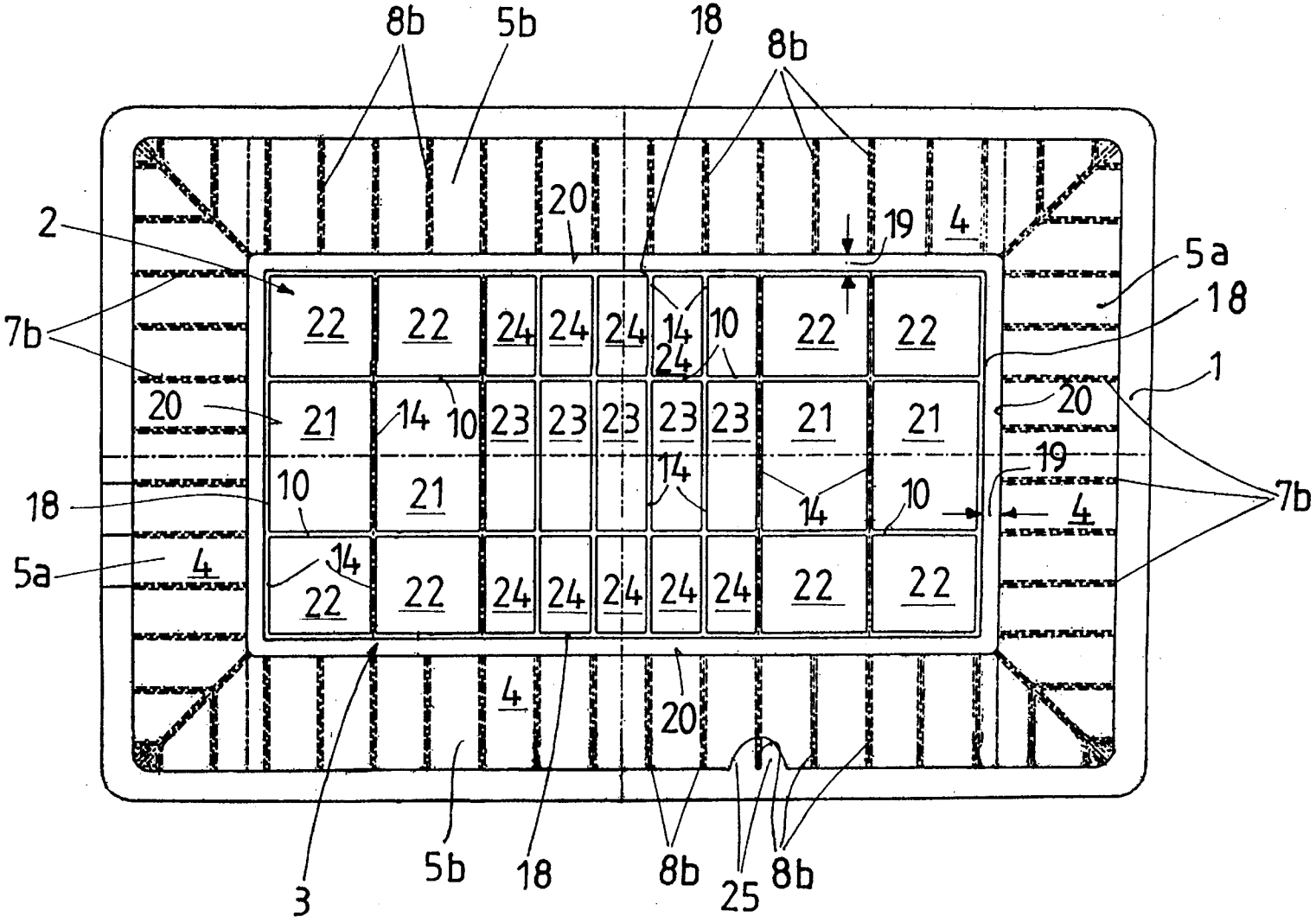
FIG. 3 is bottom view of yet another embodiment of the container according to the present invention.

Another embodiment of the container bottom 1, in which the support surface 4 is uncoupled from the center field 3 of the bottom 1, is illustrated in FIG. 3. In this case, the center field 3 of the bottom 1 is enclosed by a rectangular, circumferentially extending, outer rib border member 18 which is arranged at a distance 19 from the inwardly directed rims 20 of the flat webs 5*a*, 5*b* which extend parallel to the rib border member 18. As a result of the distance 19, the flat webs 5*a*, 5*b* are uncoupled from the center field 3 because the center field 3 is not connected to the flat webs 5*a*, 5*b* or the support surface 4. A high stiffness of the bottom 1 is achieved in this embodiment by providing the grid 2 of ribs with grid fields 21, 22, 23 and 24 of different sizes, wherein especially the grid fields 23, 24 arranged in the center field 3 of the bottom 1 are much narrower than the in longitudinal direction outer grid fields 21 and 22. In addition, the grid fields 22 and 24 arranged in the upper and lower grid rows as seen in the drawing are shorter than grid fields 21 and 23 in the middle row of the grid 2.

In all embodiments of the bottom 1 illustrated in FIGS. 1–3, the flat webs 5*a*, 5*b*, the stiffening ribs 7*a*, 7*b* and 8*a*, 8*b* and the bottom surface of the container bottom are arranged adjacent a plurality of tunnel-like free spaces 25 which are arranged one next to the other. To ensure that any water collecting when the container is cleaned in the grid 2 of ribs or in the grid fields 21 to 24 in the embodiment of FIG. 3 can flow through the tunnel-like free spaces 25 toward the outside, the longitudinally extending stiffening ribs 10 and/or the transversely extending stiffening ribs 14 and/or the rib border member 18 have an opening at least at one location in the vicinity of the bottom 1, so that flow connections for water removal are achieved and the cleaning water can flow off automatically.

The invention is not limited by the embodiments described above which are presented as examples only but can be modified in various ways within the scope of protection defined by the appended patent claims.

I claim:

1. A box-shaped container of plastics material, particularly a storage and transport container, the container including a bottom and side walls extending upwardly from the bottom, the bottom having a rim, a flat upper side and a bottom side, stiffening ribs attached to the bottom side for stabilizing the bottom, further including flat webs extending in a plane parallel to the bottom and along the rim of the bottom, the flat webs forming, in the manner of a frame, a center field of the bottom, the stiffening ribs in the center field intersecting each other in the manner of a grid, the flat webs forming support surfaces of the container and being connected, spaced apart from the bottom, to the stiffening ribs arranged transversely of the rim of the bottom, wherein pocket-shaped free spaces are formed between the bottom side of the container bottom, upper sides of the flat webs and the transversely extending stiffening ribs, such that the free spaces are completely open at the rim of the bottom, wherein the improvement comprises that the stiffening ribs connected to the flat webs are spaced apart, separate, and distinct from the stiffening ribs of the center field.

2. The box-shaped container according to claim 1, further comprising longitudinal ribs and transverse ribs attached to the bottom side and extending from the grid of ribs in the center field, wherein the stiffening ribs connected to the flat webs are arranged so as to overlap with the longitudinal ribs and the transverse ribs.

3. The box-shaped container according to claim 2, wherein the grid of ribs in the center field includes longitudinally extending stiffening ribs and transversely extending stiffening ribs, the transversely extending stiffening ribs having end branches directed toward the flat webs, each transverse rib being arranged between two end branches, and wherein the stiffening ribs connected to the flat webs are extended into the center field and are arranged adjacent the longitudinal ribs.

4. The box-shaped container according to claim 3, wherein the end branches are arranged in alignment with and at a distance from the stiffening ribs connected to the flat webs.

5. The box-shaped container according to claim 1, wherein the flat webs form a frame-like support surface having corners, the stiffening ribs connected to the flat webs including stiffening ribs located in the corners, wherein the stiffening ribs located in the corners intersect each other in a point of intersection in the center field and are connected to each other through a corner rib connection.

6. The box-shaped container according to claim 5, further comprising a stiffening angle attached to the bottom side and arranged spaced from the corner rib connection in the center field.

7. The box-shaped container according to claim 1, wherein the flat webs forming a frame-like support surface have inwardly directed rims, further comprising an outer rib border member surrounding the center field, the inwardly directed rims being arranged at a distance from the outer rib border member.

8. The box-shaped container according to claim 7, wherein the grid of ribs in the center field defines individual grid areas of different sizes.

9. The box-shaped container according to claim 1, wherein the stiffening ribs in the center field have at least one opening located near the bottom side.

* * * * *